United States Patent [19]

Darling

[11] 4,005,628

[45] Feb. 1, 1977

[54] TUNING KEY FOR STRINGED INSTRUMENTS

[75] Inventor: Myron E. Darling, Webster City, Iowa

[73] Assignee: B.J.D. Industries, Minneapolis, Minn.

[22] Filed: Sept. 5, 1975

[21] Appl. No.: 610,544

[52] U.S. Cl. ..... 84/304; 84/305

[51] Int. Cl.[2] ..... G10D 3/14

[58] Field of Search ..... 84/304, 305, 312

[56] References Cited

UNITED STATES PATENTS

| | | | |
|---|---|---|---|
| 639,341 | 12/1899 | Beauvais | 84/305 |
| 1,135,314 | 4/1915 | Oberhoffer | 84/305 |
| 1,351,616 | 8/1920 | Burke | 84/304 |
| 1,422,738 | 7/1922 | Caspari | 84/304 |
| 3,459,092 | 8/1969 | Thompson | 84/305 |

*Primary Examiner*—Stephen J. Tomsky
*Attorney, Agent, or Firm*—Henderson, Strom & Sturm

[57] ABSTRACT

A head piece, for grasping by a musician, having a stem joined thereto, the stem having elongated teeth which are formed thereon and disposed radially with respect to the longitudinal axis of the stem and head piece. A ratchet body having a bore therethrough is placed over a spindle, and the spindle is threaded into the head piece such that the spindle and head piece are rotatable as a unit. The ratchet body has elongated teeth formed thereon which are radially disposed about the bore of the ratchet body and which mesh with the teeth formed on the stem. The meshing teeth allow rotation of the head piece and spindle in one direction only with respect to the ratchet body, thereby causing a string of a musical instrument attached to the spindle to be wound about the spindle and secured in a taut condition.

7 Claims, 5 Drawing Figures

TUNING KEY FOR STRINGED INSTRUMENTS

BACKGROUND OF THE INVENTION

This invention relates to musical instruments and particularly to key structures for tuning stringed instruments. The tuning keys are situated in the head of an instrument and receive the strings of the instrument, the strings being variously wound upon the keys to desired tautnesses during tuning of the instrument. The violin and viola and related instruments have peg boxes, situated at the end of the neck of each instrument, for receiving the tuning keys of the instruments.

Peg boxes typically have a pair of parallel sides or cheeks joined at one end by a cross member, and having therebetween a hollowed out space or mortise. By using reamer tools, tapered apertures are formed through the cheeks for receiving the tuning pegs. The pegs are typically wooden and tapered and are wedged into the apertures in the cheeks. Strings are held taut by the friction of the pegs against the walls of the apertures. Much time and effort is involved in forming the tapered apertures and pegs such that a proper fit is achieved. The tapered pegs also are subject to slippage and to wear. The pegs may be wedged too tightly such that the peg box eventually is cracked, or the pegs may be too loosely fitted and therefore pop out of the peg box. Adjustment of the string is also difficult for, in turning the peg, frictional forces must be overcome as well as the pull of the string being tightened.

Other types of tuning keys have been developed which are not supported by both cheeks of a peg box. These keys are affixed to only one cheek of a peg box, the keys passing through an aperture in the cheek and having structure which clamps the cheek or having special insert structure within the aperture of the cheek for receiving the key. The clamping and insert structures are complex and cumbersome and do not provide the best support for the tuning keys.

SUMMARY OF THE INVENTION

A tuning key for stringed instruments is provided with a formed head piece having a thumb piece which is hand-engageable by the musician. A stem is joined to the thumb piece, and elongated teeth are formed upon the stem and radially disposed with respect to the longitudinal axis of the stem and thumb piece. A ratchet body having a bore formed axially therethrough is fitted over a spindle. The spindle is threaded into the head piece such that the spindle and head piece are rotatable as a unit and with respect to the ratchet body. Elongated teeth are formed on the ratchet body, are radially disposed about the bore, and mesh with the teeth upon the stem. The teeth have sloped surfaces such that rotation of the head piece and spindle with respect to the ratchet body is permitted in one direction only, the string of the instrument being attached to and wound upon the spindle and secured at a particular tautness. The head piece is pulled outwardly of the ratchet body to disengage the teeth and to thereby permit reverse rotation of the head piece and spindle to lessen the tautness of the string.

It is an object of this invention to provide a novel tuning key for stringed instruments which is neither cumbersome nor complex of construction nor complex of operation.

It is another object of this invention to provide a tuning key which will attach to the peg box of a stringed instrument in a stable manner and remain securely attached thereto without damaging the structure of the peg box.

Still another object of this invention is to provide a tuning key which will tighten a string and positively lock the string at a particular tautness, eliminating reliance upon frictional engagement of parts for holding a string taut and consequent problems of string slippage.

A further object of this invention is to provide a tuning key which is attached more securely in the peg box due to turning forces applied to the key by the string when the string is taut.

Yet another object of this invention is to provide a tuning key which is economical of manufacture yet capable of achieving the aforementioned objects.

These objects and other features and advantages of the tuning key of this invention will become readily apparent upon referring to the following description, when taken in conjunction with the appended drawings.

BRIEF DESCRIPTION OF THE DRAWINGS

The tuning key, for stringed instruments, of this invention is illustrated in the drawings wherein.

DESCRIPTION OF THE PREFERRED EMBODIMENT

Figure 1:
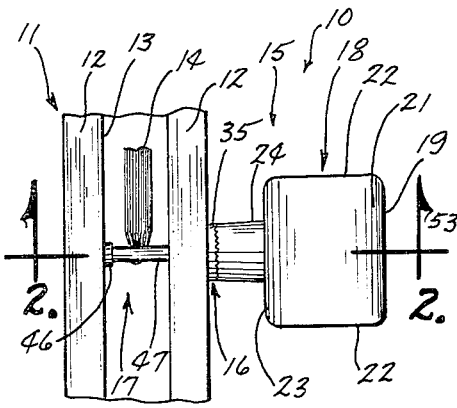
FIG. 1 is a fragmentary, top plan view of the tuning key in attachment with the peg box of a stringed instrument and having a string attached thereto.
Figure 3:
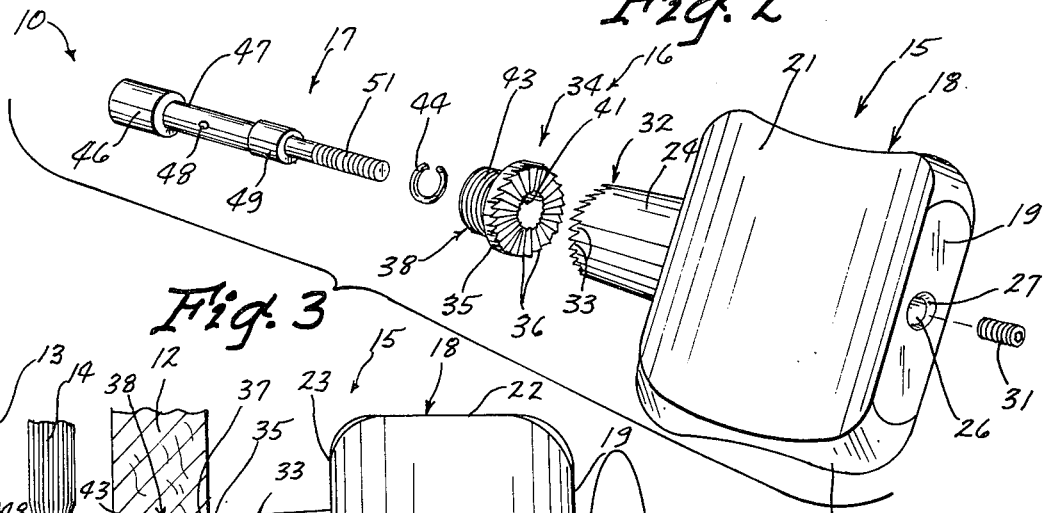
FIG. 3 is an exploded view of the tuning key showing the various components thereof.

Referring now to the drawings, the tuning key of this invention is indicated generally at 10 in FIG. 1 in attachment with the peg box 11 of a stringed instrument such as a violin. The peg box 11, as is well known, includes a pair of upstanding sides or cheeks 12 having a mortise 13 formed therebetween. A string 14 of the instrument is shown in attachment with the key 10. As shown in FIGS. 1 and 3, the tuning key 10 more specifically includes a head piece 15, a ratchet mechanism 16, and a spindle mechanism 17.

Figure 2:
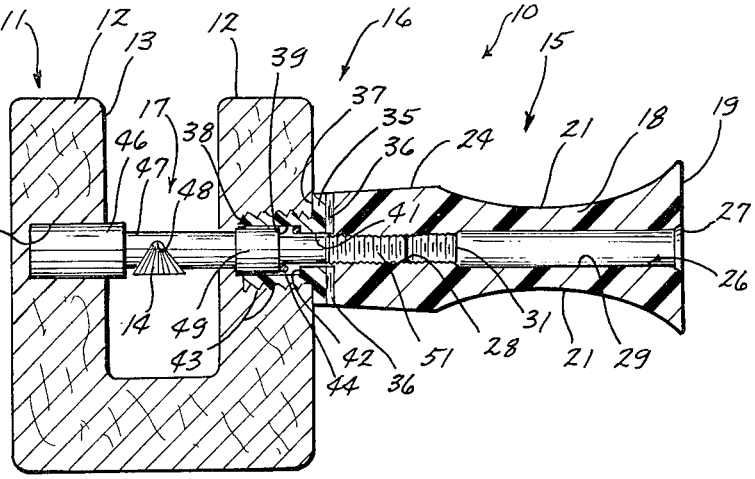
FIG. 2 is an enlarged longitudinal sectional view of the tuning key taken along line 2—2 of FIG. 1.

Referring to FIGS. 2 and 3, the head piece 15 includes a handle or thumb piece 18. The thumb piece 18 has a flat, elongated outer end surface 19 and a pair of concave surfaces 21, on opposite sides of the thumb piece 18, which meet the end surface 19 along each of the longitudinal edges of the end surface 19. Narrow surfaces 22 at the top and bottom of the thumb piece 19 join the top edges and bottom edges of the end surface 19, concave surfaces 21 and the inner surface 23. The concave surfaces 21 meet the inner surface 23 along the longitudinal edges of the surface 23, which surface 23 is on the opposite side of the thumb piece 18 from end surface 19. A conical-frustum shaped stem piece 24 extends from the thumb piece 18, perpendicular to and intermediate the ends of inner surface 23.

The stem 24 tapers as it extends away from the thumb piece 18.

A first bore 26, circular in diameter, passes axially through the stem 24 and passes through the thumb piece 18 intermediate the surfaces 22 to emerge through end surface 19 intermediate the top and bottom edges thereof and intermediate the longitudinal edges thereof. The bore 26 has a flared opening 27 adjacent the end surface 19. The bore 26 has a first threaded portion 28 extending through the stem 24, past the plane of the inner surface 23 part way into the thumb piece 18. The bore 26 has a smooth-walled portion 29 extending between the first threaded portion 28 and the flared opening 27. An adjusting set screw 31 is threaded into the portion 28.

The ratchet mechanism 16, shown in FIGS. 2 and 3, includes a right ratchet face 32 having teeth 33 formed in the end of the stem 24 which is directed away from inner surface 23. The teeth 33 are elongated and uniformly radially disposed about the bore 26. Each of the teeth 33 have one surface which defines a plane parallel to the bore 26 and one surface which is inclined, sloping in the direction of a right-handed rotation of the stem 24. The ratchet mechanism 16 also includes a ratchet body 34 having a disc or rim portion 35. The disc portion 35, on the face adjacent the ratchet face 32, has teeth 36 formed thereon. The teeth 36 each have one surface which defines a plane parallel to the bore 26 and one inclined surface which slopes in the direction of a left-handed rotation of the stem 24.

A shoulder 37 is formed by the side of the disc 35 which is opposite the side thereof having the formed teeth 36. A cylindrical portion 38 is perpendicularly joined to the center of the shoulder 37 forming side of the disc 35. A bore passes axially through the ratchet body 34, having a portion 39 which has a greater diameter than the bore 26 and which passes most of the way through the cylindrical portion 38, and having a reduced portion 41 which has the same diameter as the bore 26 and which passes through the disc portion 35 and part way through the cylindrical portion 38. An internal shoulder 42 is formed at the juncture of the portion 39 and the reduced portion 41 of the bore. The exterior surface of the cylindrical portion 38 is threaded as at 43. The exterior threaded portion 43 has a threading opposite that of the bore portion 28 and the set screw 31. The threaded portion 43 extends a length equal to that of the bore portion 39. A spring 44 is located within the bore portion 39 and engages the shoulder 42.

The spindle mechanism 17, FIGS. 2 and 3, includes a first end portion 46. A spool portion 47 extends from the end 46 and has a reduced cross-sectional diameter. An aperture 48 is formed through the spool 47. An enlarged shoulder-forming portion 49 is joined to the spool 47, and the spindle 17 terminates in a free end 51 extending from the shoulder 49. The free end 51 is threaded in the same handedness as the bore portion 28 and set screw 31. The end 46, spool 47, shoulder 49 and free end 51 are axially aligned.

The spindle mechanism 17 is received through the ratchet mechanism 16 into the head piece 15. The free end 51 passes through the bore portions 39, 41 of the ratchet body 34 and is screwed into the first threaded portion 28 of the bore 26 to a position of abutment with the screw 31. The spring 44 encircles the free end 51 and extends between, and engages both, the shoulder 42 and the shoulder 49. The teeth 33 mesh with the teeth 36, and the shoulder 49 fits within the bore portion 39.

When the tuning key 10 is to be used, the set screw 31 is threaded into the bore portion 28 the desired distance. The tension of the spring 44 is thereby adjusted, since the distance which the free end 51 may be threaded into bore portion 28 is determined by the setting of the screw 31, and the spacing of the shoulders 42, 49 determines the tension upon the spring 44. The tension upon the spring 44 also determines how tightly the teeth 33, 36 mesh together.

Figure 4:
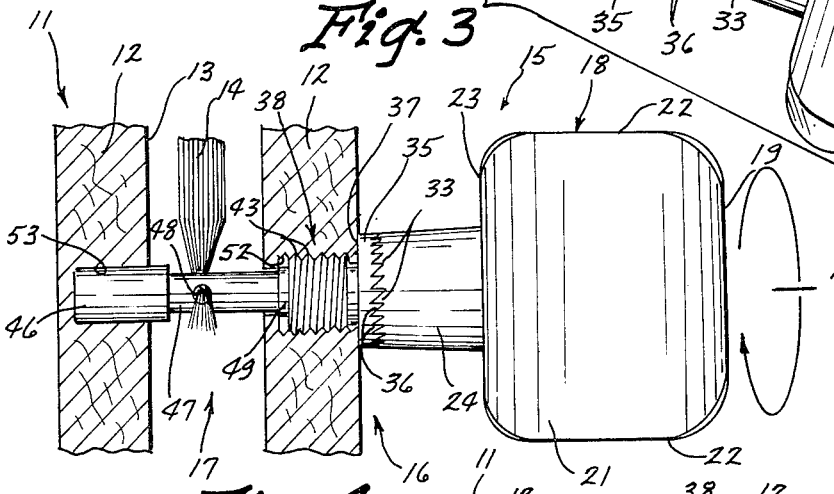
FIG. 4 is an enlarged, fragmentary top plan view of the tuning key depicting operation of the key to tighten the string of an instrument, the peg box being shown in horizontal section.
Figure 5:
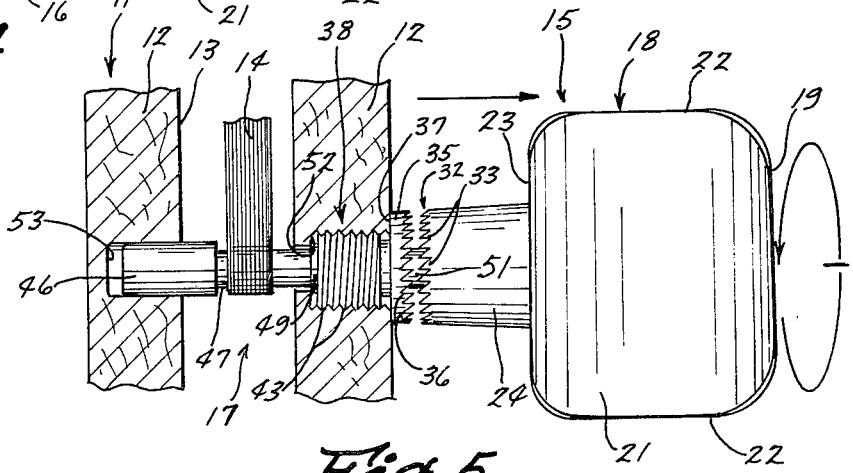
FIG. 5 is an enlarged, fragmentary top plan view of the tuning key showing operation of the key to loosen the string of an instrument, the peg box again being shown in horizontal section.

After the set screw 31 has been adjusted to the appropriate position along the length of the bore portion 28, the ratchet body 34 is placed over the spindle mechanism 17, and the spindle 17 is threaded into the head piece 15, the free end 51 being threaded against the screw 31 to ensure that the head piece 15 and spindle 17 rotate as a unit. The tuning key 10 then is attached to the peg box 11 of the stringed instrument, the spindle 17 being projected through an aperture 52 in one of the cheeks 12, extended through the mortise 13 and inserted into a depression 53 formed in the inner side of the other cheek 12, as shown in FIGS. 4 and 5. The aperture 52 is threaded, and the ratchet body 34 is screwed into the aperture 52. The shoulder 37 of the ratchet body 34 rests against the cheek 12 to additionally stabilize the tuning key 10 in the peg box 11.

After the tuning key 10 is secured in the peg box 11, a string 14 of the instrument is passed through the aperture 48 in the spool 47, as shown in FIG. 4. The thumb piece 18 is engaged by the musician, and the head piece 15 and the spindle 17 are rotated as a unit in a right-handed direction. The meshed teeth 33, 36 permit rotation of the stem 24 with respect to the disc 35 in the right-handed direction, the teeth 33 sliding over the teeth 36. The teeth 33, 36 engage in a locking manner to prevent rotation in the opposite direction, thereby securing the tautness of the string 14. The string 14 in attempting to unwind tries to impart a left-handed rotation to the spindle 17 and head piece 15. This motion is resisted by the ratched body 34 due to the meshing of the teeth 33, 36, the ratchet body 34 being threaded more securely into aperture 52 since the threads 43 are left-handed.

When the tautness of the string 14 is to be lessened, the musician grasps the thumb piece 18 and pulls the head piece 15 and spindle 17 partially outwardly of the peg box 11 such that the teeth 33 are disengaged from the teeth 36, as shown in FIG. 5. A left-handed rotation is then imparted to the head piece 15 and spindle 17 which results in the unwinding of the string 14 such that it becomes less taut. When the string 14 has attained the appropriate tautness, the musician lets go of the thumb piece 18, and the spring 44, having been compressed when the head piece and spindle 17 were drawn outwardly of the peg box 11, now acts against the shoulders 42, 49 to draw the spindle 17 and head piece 15 back into the peg box 11 and the teeth 33, 36 back into meshing relationship. The new tautness of the string 14 is thereby secured.

The tuning key 10 is supported by both cheeks 12 of the peg box 11 and is therefore firmly supported. The tuning key 10 is not wedged into the aperture 52 and depression 53, and therefore the peg box 11 is less likely to be cracked. The tuning key 10 does not rely on friction but rather the positive action of the ratchet mechanism 16 to hold the string 14 secure at a certain tautness, thereby eliminating the slippage problems and consequent need for frequent adjustment attendant with conventional tuning pegs. The pull of the string 14 itself upon the tuning key 10 further secures the key 10 in the peg box 11. The components of the tuning key 10 can be formed easily out of plastic or other suitable materials and therefore economically manufactured. Thus it can be seen that the objects of this invention have been attained. Furthermore, although a preferred embodiment has been disclosed herein, it is to be remembered that various modifications and alternate constructions can be made thereto without departing from the full scope of the invention, as defined in the appended claims.

I claim:

1. A tuning key for stringed instruments having a peg box having an opening therein comprising:

an elongated spindle member rotatably received in said peg box opening;

a head piece connected to one end of said spindle member;

ratchet means for alternately engaging said head piece and disengaging therefrom to allow effective rotational motion of said head piece and said spindle member with respect to said peg box in one direction only when engaged, whereby the tautness of a string wound upon said spindle member is maintained, and to allow rotational motion in the opposite rotational direction when disengaged, whereby the tautness of the string is lessened, said ratchet means comprising:

means secured to said peg box for allowing longitudinal movement of said spindle member between a first and a second longitudinal position with respect to said peg box;

means in engagement with said spindle member for biasing said spindle member to said first position;

first tooth means rigidly attached to said peg box; and second tooth means rigidly attached to said head piece for selectively engaging said first tooth means, said second tooth means being in engagement with said first tooth means in said first position and disengaged from said first tooth means in said second position.

2. A tuning key as defined in claim 1 wherein said head piece has a first bore formed therethrough, said first bore having a first threaded portion, said spindle member having a first end and a free end, said free end having threads thereon, said free end being screwed into said first threaded portion, said ratchet means including a ratchet body having a bore formed therethrough, said spindle means being received through said ratchet body bore, said ratchet body having an exterior second portion threaded oppositely of said first threaded portion and said spindle member free end and threaded into the opening of the peg box adjacent said head piece, whereby torque exerted by the string upon said spindle member while taut secures said ratchet body more permanently into the peg box opening when said spindle member is in said first longitudinal position.

3. A tuning key as defined in claim 2 and further wherein said first end of said spindle is enlarged and is rotatably and removably inserted into a cheek of the peg box.

4. A tuning key as defined in claim 3 and further wherein said spindle has a spool portion adjacent said first end, said spool having an aperture formed therethrough, the string of the instrument being received into said aperture.

5. A tuning key as defined in claim 1 wherein said ratchet means includes a ratchet body, said ratchet body having said first tooth means formed thereon, said first tooth means including a plurality of elongated, inclined, first teeth formed thereon, said second tooth means including a plurality of elongated, inclined, second teeth, said first and second teeth being radially disposed about the axis of rotation of said spindle member and said head piece, said ratchet body having a bore formed therethrough for slidably receiving said spindle member.

6. A tuning key as defined in claim 5 and further wherein said spindle member has a first end and a free end and a shoulder portion between said first end and said free end, said bore of said ratchet body having a portion of reduced diameter adjacent said free end of said spindle thereby forming an internal shoulder intermediate the ends of said bore, said biasing means including a spring member, said spring member encircling said spindle member and extending between and pressing against both said shoulder portion and said internal shoulder.

7. A tuning key as defined in claim 6 and further wherein said head piece has a first threaded portion formed therein said head piece having an adjusting set secrew threaded into said first threaded portion, said free end of said spindle being received into said first threaded portion to abutment with said screw, whereby adjustment of said screw along the length of said first threaded portion varies the tension of said spring.

* * * * *